US008177653B2

(12) United States Patent
Antolick

(10) Patent No.: US 8,177,653 B2
(45) Date of Patent: May 15, 2012

(54) WEARABLE SWING TRAINING APPARATUS

(76) Inventor: Jeffrey B. Antolick, Drums, PA (US)

( * ) Notice: Subject to any disclaimer, the term of this patent is extended or adjusted under 35 U.S.C. 154(b) by 46 days.

(21) Appl. No.: 12/795,453

(22) Filed: Jun. 7, 2010

(65) Prior Publication Data

US 2010/0311514 A1 Dec. 9, 2010

Related U.S. Application Data

(60) Provisional application No. 61/185,071, filed on Jun. 8, 2009.

(51) Int. Cl.
*A63B 69/36* (2006.01)
*A63B 69/00* (2006.01)

(52) U.S. Cl. ..... 473/217; 473/452; 473/458

(58) Field of Classification Search ..... 473/217, 473/266, 270, 272, 278, 452, 458
See application file for complete search history.

(56) References Cited

U.S. PATENT DOCUMENTS

| | | | | |
|---|---|---|---|---|
| 3,207,510 | A * | 9/1965 | Gibson | 482/71 |
| 4,739,986 | A * | 4/1988 | Kucharik et al. | 482/79 |
| 5,667,462 | A * | 9/1997 | Gordon | 482/80 |
| 5,707,298 | A | 1/1998 | Chovanes | |
| 5,810,673 | A | 9/1998 | Castleberry | |
| 5,856,743 | A | 1/1999 | Juniman | |
| 6,749,529 | B1 * | 6/2004 | Sobolewski | 473/451 |
| 6,767,313 | B2 * | 7/2004 | Sayce | 482/71 |
| 2001/0033415 | A1 | 10/2001 | Funatsu | |
| 2002/0128133 | A1 | 9/2002 | Broudy | |
| 2003/0224882 | A1 | 12/2003 | Mahoney | |
| 2008/0085788 | A1 | 4/2008 | Rainer et al. | |

FOREIGN PATENT DOCUMENTS

WO 2008064919 A1 6/2008

* cited by examiner

*Primary Examiner* — Nini LeGesse
(74) *Attorney, Agent, or Firm* — John R. Kasha; Kasha Law LLC

(57) ABSTRACT

A swing training apparatus includes a first plate, a second, plate, a moveable joint, and an angular resistance mechanism. The movable joint connects the first plate to the second plate so that the first plate can rotate with respect to the second plate and about a shared plate axis of rotation. The angular resistance mechanism is connected between the first plate and the second plate. It increases angular resistance between the first plate and the second plate as an angle of rotation about the plate axis of rotation is increased. A shoe of an athlete contacts the first plate. The shoe is positioned on the first plate so that, as the athlete rotates a foot and the shoe enclosing the foot with respect to a part of the foot and about a foot axis of rotation, the foot axis of rotation and the plate axis of rotation coincide.

19 Claims, 3 Drawing Sheets

WEARABLE SWING TRAINING APPARATUS

CROSS-REFERENCE TO RELATED APPLICATION

This application claims the benefit of U.S. Provisional Patent Application No. 61/185,071 filed Jun. 8, 2009.

INTRODUCTION

Back foot lockout is one of the most common problems facing many baseball players and golfers, which is typically not addressed by instructors and coaches. Back foot lockout occurs when the athlete fails to properly rotate their back foot during the course of their swing. This improper rotation of the back foot creates an improper rotation of the athlete's hip or, in some circumstances, no rotation of the athlete's hip. In the prior art various types of swing trainers have been proposed. These swing training devices have included an upper and lower plate that rotate with respect to each other and allow a user to rotate their back foot while swinging a club or bat. These devices are generally not portable and are only useful under strict training conditions.

BRIEF DESCRIPTION OF THE DRAWINGS

The skilled artisan will understand that the drawings, described below, are for illustration purposes only. The drawings are not intended to limit the scope of the present teachings in any way.

Figure 1:
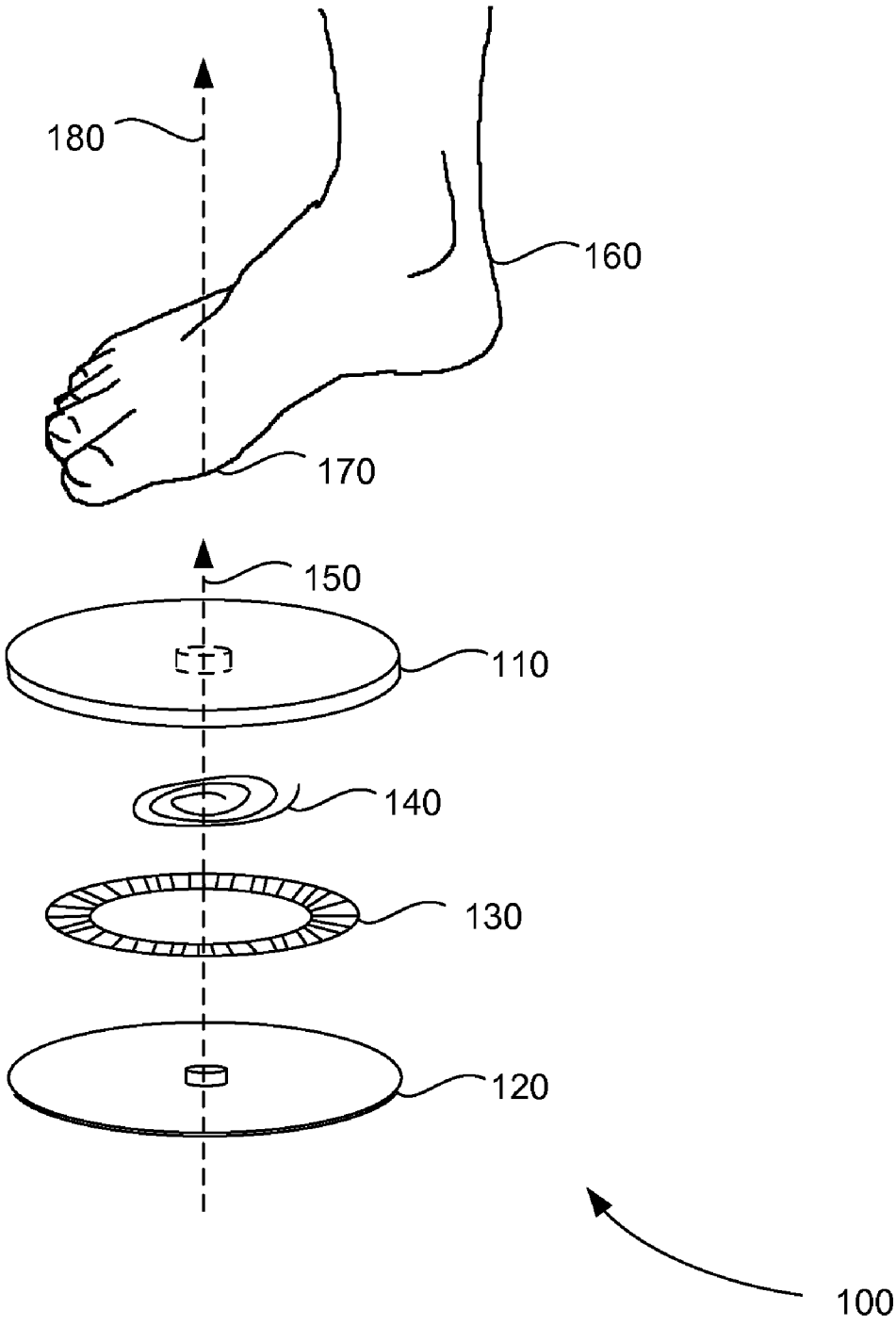
FIG. 1 is an exploded view of a swing training apparatus, in accordance with various embodiments.

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF VARIOUS EMBODIMENTS

As described above, back foot lockout occurs when an athlete fails to properly rotate their back foot during the course of a swinging motion. The swinging motion may be performed in sports including, but not limited to, baseball, softball, golf, cricket, lacrosse, or field hockey. Back foot lockout, in turn, can result in little or no hip rotation during a swing. As a result, the proper rotation of the back foot during a swing is an important part of good swing mechanics.

In various embodiments, a wearable swing training apparatus allows an athlete to more easily rotate their back foot under realistic playing conditions. The apparatus includes a first plate and a second plate. The first plate is positioned above the second plate, and is attached to the second plate so that it can rotate with respect to the second plate. The first plate and the second plate are attached by way of a movable joint that can include, but is not limited to including, bearings, self lubricating plastic, acrylic, rubber, or any other durable and wearable substance. The moveable joint can be enclosed to avoid debris from entering the joint. The moveable joint is enclosed by an o-ring, for example.

The first plate is also attached to the shoe of the back foot of an athlete. The shoe can include, but is not limited to, a sneaker, a cleat, a training shoe, a playing shoe, a golf shoe, or any other type of shoe. The first plate is attached to the shoe so that the back foot can rotate with respect to a part of the foot.

For a baseball swing, for example, the athlete may want to learn how to rotate their back foot with the axis of rotation centered near the ball of the foot. As a result, in various embodiments, the first plate is attached to the shoe so that the axis of rotation of the first plate corresponds to or coincides with the axis of rotation of the ball of the back foot of the athlete.

Alternatively, for a golf swing, for example, the athlete may want to learn how to rotate their back foot with the axis of rotation centered near the toes of the foot. As a result, in various embodiments, the first plate is attached to the shoe so that the axis of rotation of the first plate coincides with the axis of rotation of the toes of the back foot of the athlete.

In various embodiments, the attachment of the first plate to the shoe is adjustable. An adjustable attachment allows the axis of rotation of the back foot of the athlete to be centered with respect to any part of the back foot.

The first plate is attached to the shoe using a wearable shoe attachment device, for example. The wearable shoe attachment device can include one or more straps that can be made of material that includes, but is not limited to including, rubber, canvas, Velcro, leather, shoe laces, metal, plastic, acrylic, netting, cloth, or any other wearable substance. The one or more straps are connected to the first plate and surround a portion of the shoe to secure the shoe to the first plate. The one or more straps also position the shoe with respect to the first plate so that the desired axis of rotation of the shoe and the back foot coincides with the axis of rotation of the first plate. The wearable shoe attachment device can also include a heel connected to the one or more straps. Because the first plate and the second plate have a thickness, a heel can be used to properly level the shoe in the swing training apparatus.

In various embodiments, the first plate is directly connected to the shoe. The shoe can be designed specifically for connection to the swing training apparatus, for example. The first plate can be connected to the shoe by means of a screw-type device, clips, knobs, snaps, or any other means of quickly and easily attaching or detaching the first plate to the shoe. The direct connection of the first plate to the shoe also positions the shoe with respect to the first plate so that the desired axis of rotation of the shoe and the back foot coincides with the axis of rotation of the first plate.

The attachment of the first plate to the shoe makes the swing training apparatus wearable. This means that the apparatus can be moved with any foot movement, including, but not limited to, walking or running. This allows the apparatus to be used in any environment, including, but not limited to, a training environment or the actual field of play. Baseball or softball players can move into and out of a batter's box during batting practice wearing the apparatus, for example The surfaces of these environments can vary significantly, however. Since the second plate of the swing training apparatus must remain fixed as the first plate rotates, the second plate has to make good contact with the surface of a training or playing environment.

In various embodiments, a swing training apparatus includes a removable third plate connected to the second plate. The third plate can be connected to the second plate by means of a screw-type device, clips, knobs, snaps, or any other means of quickly and easily attaching or detaching the third plate to or from the second plate. On the side not connected to the second plate, the third plate has a surface designed to provide good grip to the training or playing environment surface. The third plate can have various surfaces that include, but are not limited to including, plastic spikes, metal spikes, rubber spikes, rubber pad, rubber knobs, plastic knobs, turf, or any other substance that allows the third plate to rest comfortably, safely and securely on a training or playing surface.

The proper rotation of the back foot during a swing is, for example, ninety degrees. A rotation beyond ninety degrees would not improve swing mechanics. In fact, a rotation beyond ninety degrees can potentially result in injury. Also, a rotation to ninety degrees or some other angle that is limited by a hard stop may potentially result in injury.

In various embodiments, the attachment of the first plate to the second plate includes a mechanism to increase angular resistance as the angle between the two plates increases to ninety degrees. This angular resistance can be linear, for example. In various embodiments, this angular resistance can be nonlinear. The mechanism to increase angular resistance between the first plate and the second plate can include, but is not limited to including, rubber bands, springs, tension screws, friction devices, an electronic mechanism, stop guards, or any other mechanism capable of increasing angular resistance. The mechanism to increase angular resistance may be located outside of the first plate and the second plate, or it may be located inside of or enclosed in the first plate, the second plate, or both. The angular resistance mechanism increases the angular resistance and slows down the motion of first plate with respect to the second plate as it rotating, so that the angle of rotation is limited and the potential for injury is reduced. The mechanism can also reset the angle of rotation between the two plates back to near zero degrees when the second plate is released from the training or playing surface.

In various embodiments, the angular resistance mechanism is adjustable in order to change the direction of angular resistance. For example, left handed and right handed batters or golfers rotate their back feet in different directions. As a result, the direction of the of the angular resistance between the first plate the second plate must change for left handed and right handed batters.

Increasing the angular resistance between the first plate and the second plate as the angle between the two plates increases to ninety degrees gives the athlete some indication of whether or not they are properly rotating their back foot. However, in the midst of concentrating on batting a moving ball or launching a ball from a tee, this type of feedback may not be noticeable to the athlete. This type of feedback is also no noticeable to an instructor or coach.

In various embodiments, a swing training apparatus includes an audible feedback mechanism that provides an indication of the angle of rotation between the first plate and the second plate. The audible feedback mechanism can provide audible clicks or tones as the angle of rotation between the first plate and the second plate increases or reaches certain angles. The audible feedback mechanism is, for example, a toothed cog that comes in contact with a paddle at certain angles and provides a clicking sound. The tooth cog and paddle can be part of the first plate, the second plate, or both. In various embodiments, the audible feedback mechanism includes an electronic circuit that measures the angle of rotation and emits tones through a speaker at certain angles.

An audible feedback mechanism can provide an athlete with some indication of whether or not they are properly rotating their back foot. However, this type of feedback may not be apparent to a coach. The coach may be too far away to hear the clicks or tones emitted by the swing training apparatus.

In various embodiments, a swing training apparatus includes a visual feedback mechanism that provides an indication of the angle of rotation between the first plate and the second plate. The visual feedback mechanism can provide flashes of light as the angle of rotation between the first plate and the second plate increases or reaches certain angles. The visual feedback mechanism includes an electronic circuit that measures the angle of rotation and emits flashes of light using a light emitting diode (LED), for example, at certain angles.

Audible or visual feedback mechanisms can significantly improve the usefulness of a swing training apparatus by giving an athlete or coach immediate information about the athlete's performance. However, good swing mechanics are generally learned over a vast number of repetitions. As a result, an improvement can sometimes only be seen after analyzing a large amount of information.

In various embodiments, a swing training apparatus includes an electronic circuit and a memory that records rotations between the first plate and the second plate over time. The electronic circuit measures the angle of rotation between the first plate and the second plate and stores each rotation that starts near zero degrees and increases to some angle above a threshold angle, for example. The electronic circuit includes an input/output port that allows the stored information to be transferred to an external memory, such as a universal serial bus (USB) memory stick. The information can then be analyzed using an external computer, for example. The memory of the swing training apparatus can be cleared or reset after each training session.

Consider, for example, an athlete who uses a swing training apparatus that includes a memory and takes batting practice. After batting practice the information about the swing training apparatus can be downloaded from the swing training apparatus. Suppose it is known that the athlete made thirty swings during batting practice. These thirty swings can be compared to the number of rotations near ninety degrees recorded by the swing training apparatus. Improvement is found if over many batting practices the number of rotations near ninety degrees approaches the number of swings.

FIG. 1 is an exploded view of a swing training apparatus 100, in accordance with various embodiments. Apparatus 100 includes first plate 110, second plate 120, moveable joint 130, and angular resistance mechanism 140. Moveable joint 130 is, for example, a bearing. Angular resistance mechanism 140 is, for example, a coiled spring. Movable joint 130 connects first plate 110 to second plate 120 so that first plate 110 can rotate with respect to second plate 120 and about shared plate axis of rotation 150. Angular resistance mechanism 140 is connected between first plate 110 and second plate 120. Angular resistance mechanism 140 increases the angular resistance between first plate 110 and second plate 120 as the angle of rotation about plate axis of rotation 150 is increased. A shoe (not shown) of an athlete contacts the first plate so that, as the athlete rotates foot 160 and the shoe enclosing the foot with respect to a part of the foot and about foot axis of rotation 180, foot axis of rotation 180 and plate axis of rotation 150 coincide. The athlete rotates foot 160 and the shoe enclosing the foot with respect to ball 170 of foot 160, for example.

Figure 2:
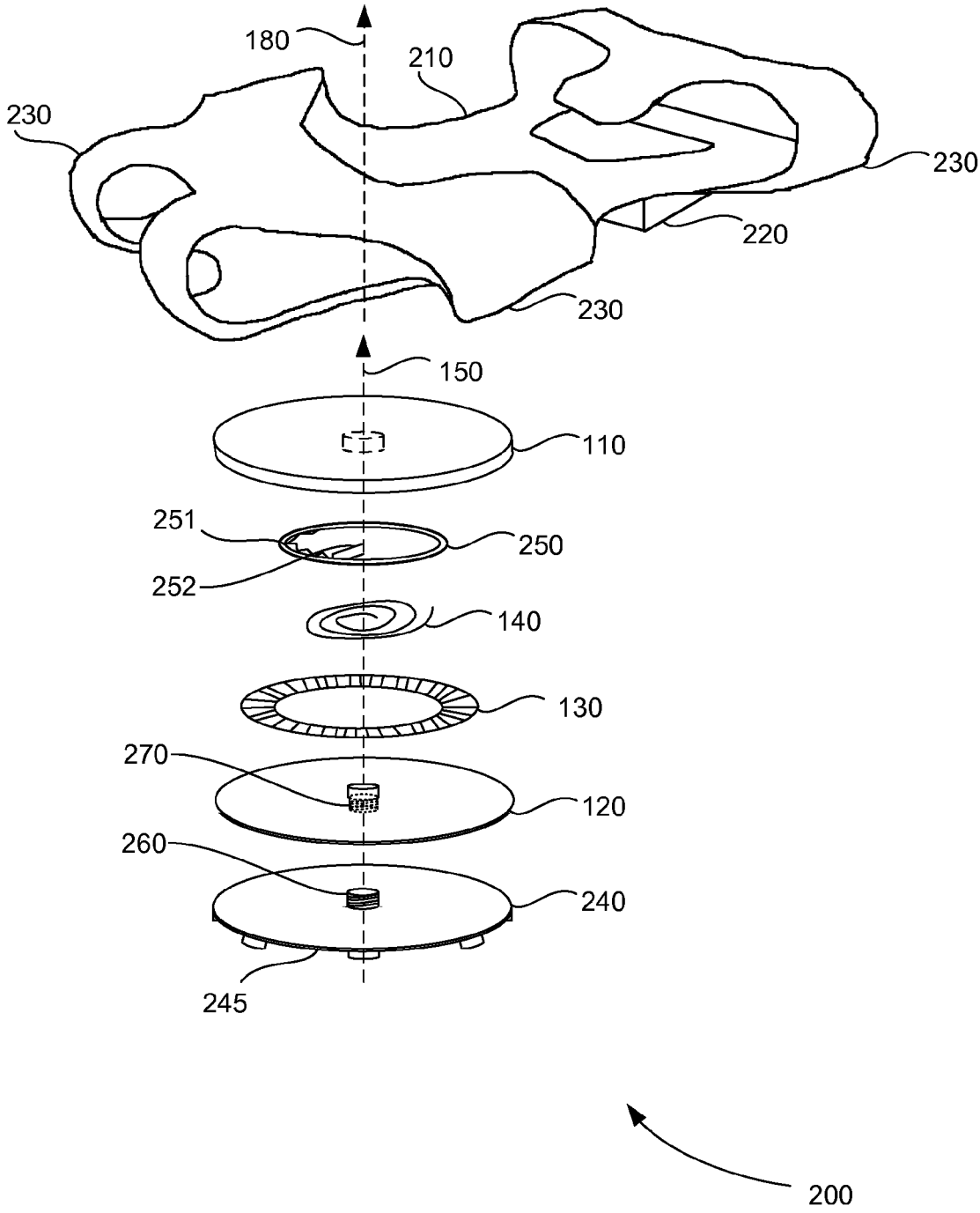
FIG. 2 is an exploded view of a swing training apparatus that includes a wearable shoe attachment device, in accordance with various embodiments.

FIG. 2 is an exploded view of a swing training apparatus 200 that includes wearable shoe attachment device 210, in accordance with various embodiments. In addition to wearable shoe attachment device 210, swing training apparatus 200 includes first plate 110, second plate 120, moveable joint 130, and angular resistance mechanism 140, which are described above. Wearable shoe attachment device 210 is connected to first plate 110 and positions a shoe (not shown) of an athlete so that, as the athlete rotates a foot (not shown) and the shoe enclosing the foot with respect to a part of the foot and about foot axis of rotation 180, foot axis of rotation 180 and plate axis of rotation 150 coincide. Wearable shoe attachment device 210 is connected to first plate 110 permanently, for example.

In various embodiments, wearable shoe attachment device 210 can include heel 220. Heel 220 can be used to properly level the shoe secured by wearable shoe attachment device 210. In various embodiments, wearable shoe attachment device 210 includes one or more straps 230 that surround a portion of the shoe to secure the shoe to first plate 110.

In various embodiments, swing training apparatus 200 can include removable third plate 240 connected to second plate 120 that includes a surface 245 adapted to grip a playing or training surface. Surface 245 is, for example, a spiked surface. Removable third plate 240 connects to the second plate 120, for example, using screw 260 of removable third plate 240 and socket 270 of second plate 120.

In various embodiments, swing training apparatus 200 can include audio feedback mechanism 250. Audio feedback mechanism 250 includes toothed cog 251 and paddle 252, for example.

Figure 3:
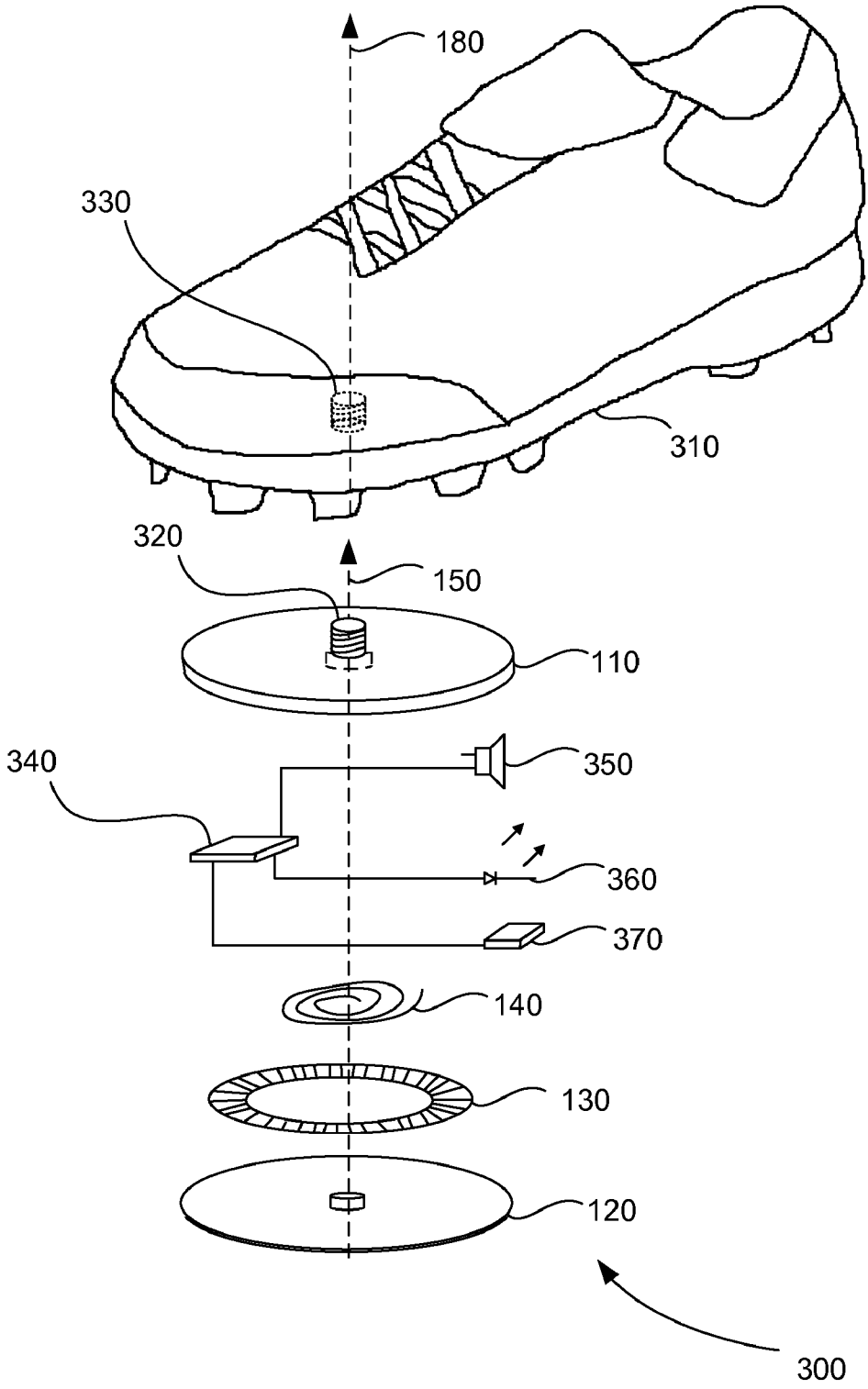
FIG. 3 is an exploded view of a swing training apparatus that includes a shoe adapted to connect to the swing training apparatus, in accordance with various embodiments.

FIG. 3 is an exploded view of a swing training apparatus 300 that includes a shoe 310 adapted to connect to swing training apparatus 300, in accordance with various embodiments. In addition to shoe 310, swing training apparatus 300 includes first plate 110, second plate 120, moveable joint 130, and angular resistance mechanism 140, which are described above. Shoe 310 connects to the first plate 110 so that, as the athlete rotates a foot (not shown) and shoe 310 enclosing the foot with respect to a part of the foot and about foot axis of rotation 180, foot axis of rotation 180 and the plate axis of rotation 150 coincide. Shoe 310 connects to the first plate 110, for example, using screw 320 of first plate 110 and socket 330 of shoe 310.

In various embodiments, swing training apparatus 300 can include electronic circuit 340. Electronic circuit 340 can measure the angle of rotation between first plate 110 and second plate 120. In various embodiments, an audio feedback mechanism can include electronic circuit 340 and speaker 350. In various embodiments, a visual feedback mechanism can include electronic circuit 340 and LED 360. In various embodiments, electronic circuit 340 and memory 370 can be used to record one or more rotations between the first plate and the second plate over time.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

What is claimed is:

1. A swing training apparatus, comprising:

a first plate;

a second plate;

a movable joint that connects the first plate to the second plate so that the first plate can rotate with respect to the second plate and about a shared plate axis of rotation;

an angular resistance mechanism connected between the first plate and the second plate that increases angular resistance between the first plate and the second plate as an angle of rotation about the plate axis of rotation is increased; and a wearable shoe attachment device that is connected to the first plate and that positions a shoe of an athlete so that as the athlete rotates a foot and the shoe enclosing the foot with respect to a part of the foot and about a foot axis of rotation the foot axis of rotation and the plate axis of rotation coincide, wherein the wearable shoe attachment device is connected to the first plate so that the swing training apparatus moves with the foot while walking or running.

2. The apparatus of claim 1, further comprising a removable third plate connected to the second plate that includes surface that grips a playing or training surface.

3. The apparatus of claim 1, further comprising an audio feedback mechanism connected between the first plate and the second plate that emits a sound as the angle of rotation between the first plate and the second plate is increased.

4. The apparatus of claim 3, wherein the audio feedback mechanism comprises a toothed cog and paddle.

5. The apparatus of claim 3, wherein the audio feedback mechanism comprises an electronic circuit and a speaker.

6. The apparatus of claim 1, further comprising a visual feedback mechanism connected between the first plate and the second plate that emits light as the angle of rotation between the first plate and the second plate is increased.

7. The apparatus of claim 1, further comprising an electronic circuit and memory, wherein the electronic circuit measures the angle of rotation between the first plate and the second plate and the memory that records one or more rotations between the first plate and the second plate over time.

8. The apparatus of claim 1, further comprising a heel connected to wearable shoe attachment device.

9. The apparatus of claim 1, wherein the angular resistance mechanism comprises a coiled spring.

10. The apparatus of claim 1, wherein the wearable shoe attachment device comprises one or more straps that surround a portion of the shoe to secure the shoe to the first plate.

11. A swing training apparatus, comprising:

a first plate;

a second plate;

a movable joint that connects the first plate to the second plate so that the first plate can rotate with respect to the second plate and about a shared plate axis of rotation;

an angular resistance mechanism connected between the first plate and the second plate that increases angular resistance between the first plate and the second plate as an angle of rotation about the plate axis of rotation is increased; and a shoe that connects to the first plate through the sole of the shoe so that as an athlete wearing the shoe rotates a foot and the shoe enclosing the foot with respect to a part of the foot and about a foot axis of rotation the foot axis of rotation and the plate axis of rotation coincide, wherein the shoe is connected to the first plate so that the swing training apparatus moves with the foot while walking or running.

12. The apparatus of claim 11, further comprising a removable third plate connected to the second plate that includes surface that grips a playing or training surface.

13. The apparatus of claim 11, further comprising an audio feedback mechanism connected between the first plate and the second plate that emits a sound as the angle of rotation between the first plate and the second plate is increased.

14. The apparatus of claim 13, wherein the audio feedback mechanism comprises a toothed cog and paddle.

15. The apparatus of claim 13, wherein the audio feedback mechanism comprises an electronic circuit and a speaker.

16. The apparatus of claim 11, further comprising a visual feedback mechanism connected between the first plate and the second plate that emits light as the angle of rotation between the first plate and the second plate is increased.

17. The apparatus of claim 11, further comprising an electronic circuit and memory, wherein the electronic circuit measures the angle of rotation between the first plate and the second plate and the memory that records one or more rotations between the first plate and the second plate over time.

18. The apparatus of claim 11, wherein the angular resistance mechanism comprises a coiled spring.

19. The apparatus of claim 11, wherein the wearable shoe attachment device comprises one or more straps that surround a portion of the shoe to secure the shoe to the first plate.

* * * * *